US006566323B1

(12) United States Patent
Littig et al.

(10) Patent No.: US 6,566,323 B1
(45) **Date of Patent: *May 20, 2003**

(54) LAUNDRY DETERGENT COMPOSITIONS COMPRISING FABRIC ENHANCEMENT POLYAMINES

(75) Inventors: Janet Sue Littig, Fairfield, OH (US); Dieter Boeckh, Limburgerhof (DE); Oliver Borzyk, Speyer (DE); Michael Ehle, Ludwigshafen (DE); Frederick Anthony Hartman, Cincinnati, OH (US); John Cort Severns, West Chester, OH (US); Shulin Zhang, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/890,679

(22) PCT Filed: Feb. 16, 2000

(86) PCT No.: PCT/US00/03942

§ 371 (c)(1),
(2), (4) Date: Aug. 3, 2001

(87) PCT Pub. No.: WO00/49124

PCT Pub. Date: Aug. 24, 2000

Related U.S. Application Data

(60) Provisional application No. 60/120,989, filed on Feb. 19, 1999.

(51) Int. Cl.[7] ..... C11D 1/00

(52) U.S. Cl. ..... 510/499; 510/302; 510/303; 510/305; 510/309; 510/311; 510/312; 510/320; 510/321; 510/322; 510/372; 510/375; 510/376

(58) Field of Search ..... 510/302, 303, 510/305, 309, 311, 312, 320, 321, 322, 372, 376, 375, 499; 8/111, 137

(56) References Cited

U.S. PATENT DOCUMENTS

| | | | | |
|---|---|---|---|---|
| 5,968,893 A | * 10/1999 | Manohar et al. | ..... | 510/475 |
| 6,087,316 A | * 7/2000 | Watson et al. | ..... | 510/400 |
| 6,127,331 A | * 10/2000 | Clearly et al. | ..... | 510/528 |

FOREIGN PATENT DOCUMENTS

| | | |
|---|---|---|
| DE | 196 43 281 | * 4/1998 |
| WO | WO 97/42282 | * 11/1997 |
| WO | WO 97/42290 | * 11/1997 |
| WO | WO 98/12296 | * 3/1998 |
| WO | WO 99/01530 A1 | 1/1999 |
| WO | WO 99/07815 A1 | 2/1999 |

* cited by examiner

*Primary Examiner*—Gregory Delcotto
(74) *Attorney, Agent, or Firm*—Kim W. Zerby; Steven W. Miller

(57) ABSTRACT

The present invention relates to laundry detergent compositions which can optionally comprise bleach, said compositions comprising from about 0.01% to about 10% by weight, of a polyalkyleneimine. These detergent compositions provide fabric appearance benefits inter alia mitigation of fabric damage via bleaching agents.

11 Claims, No Drawings

LAUNDRY DETERGENT COMPOSITIONS COMPRISING FABRIC ENHANCEMENT POLYAMINES

This application is a 371 of PCT/US00/03942 filed Feb. 16, 2000 which claims the benefit of provisional application No. 60/120,989 filed Feb. 19, 1999.

FIELD OF THE INVENTION

The present application relates to laundry detergent compositions which compose one or more high molecular weight polyamines which provide enhanced fabric appearance benefits. The high molecular weight polyamines of the present invention which mitigate fabric damage and improve fabric appearance are combined with detersive surfactants and optionally a bleaching system for use in high and low density granular, heavy duty and light duty liquids, as well as laundry bar detergent compositions.

BACKGROUND OF THE INVENTION

Formulators of fabric care and laundry detergent compositions include various ingredients, inter alia surfactants, cationic softening actives, anti-static agents dye transfer inhibitors, and bleach-damage mitigating agents, for the purpose of improving cleaning, fabric appearance, fabric feel, fabric color and to extend the duration of fabric life. Ingredients which are added to the compositions must not only provide a benefit, but must be compatible with a variety of product forms, i.c. high density granules, liquid dispersions, isotropic liquids including clear, colorless/translucent liquids which may include principal solvents inter alia 1,2-hexanediol, 2,2,4-trimethyl-1,3-pentanediol (TNPD).

Color integrity is an important aspect of fabric enhancement. In addition, thoroughness of cleaning is of primary importance to the consumer.

Consumers use bleach-containing compositions when washing colored fabric as well as white fabric because the use of a bleaching material satisfies the consumers need to feel that the fabric has been "thoroughly cleaned". Therefore, there is a long felt need to provide colored fabric with protection against the pejorative effects of laundry-added bleaching materials and to protect fabric itself from the mechanical damage done to fabric through wear and the wash cycle. In addition, there is a need for these protective materials to be highly water soluble or water dispersible, while exhibiting a high degree of fabric substantivity. And there is also a need for a bleach-damage and/or fabric enhancement material which will provide a high level of fabric protection on an efficient per unit weight basis.

SUMMARY OF THE INVENTION

The present invention meets the aforementioned needs in that it has been surprisingly discovered that high molecular weight polyalkyleneimines, preferably polyethyleneimines, having a molecular weight of at least about 5200 daltons, are suitable for use in high and low density granular, heavy duty and light duty liquids, as well as laundry bar detergent compositions to provide fabric appearance benefits inter alia mitigation of fabric damage via bleaching agents, prevention of fabric mechanical damage.

A first aspect of the present invention which relates to laundry detergent compositions comprising:

a) from about 0.01% by weight, of a polyalkyleneimine having the formula:

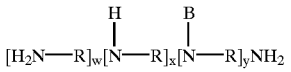

wherein R is $C_2$–$C_4$ linear alkylene, $C_3$–$C_4$ branched alkylene, and mixtures thereof; B is a continuation of said polyalkyleneimine by branching; w is equal to y+1; x is an integer of from about 50 to about 2500; y is an integer of from about 20 to about 1000;

b) from about 0.01% by weight, of a detersive surfactant selected from the group consisting of anionic, cationic, nonionic, zwitterionic, ampholytic surfactants, and mixtures thereof; and c) the balance carriers and adjunct ingredients.

A further aspect of the present invention relates to laundry detergent compositions which comprise a bleaching system and the herein described polymers.

These and other objects, features, and advantages will become apparent to those of ordinary skill in the art from a reading of the following detailed description and the appended claims. All percentages, ratios and proportions herein are by weight, unless otherwise specified. All temperatures are in degrees Celsius (°C.) unless otherwise specified. All documents cited are in relevant part, incorporated herein by reference.

DETAILED DESCRIPTION OF THE INVENTION

The present invention relates to laundry detergent compositions providing fabric enhancement, said compositions comprise from about 0.01%, preferably from about 0.1%, more preferably from 0.25%, most preferably from about 0.5% to about 20%, preferably to about 10%, more preferably to about 5% by weight, of one or more high molecular weight polyalkyleneimines, preferably polyethyleneimines. The compositions of the present invention provide increased color fidelity benefits to fabric in addition to other desirable benefits, inter alia fabric cleanliness, fabric softness, fabric integrity, fabric appearance, fabric lubricity. The laundry detergent and/or fabric enhancement compositions may take any form, for example, solids (i.e., powders, granules, extrudates), gels, thixotropic liquids, liquids (i.e., dispersions, isotropic solutions).

For the purposes of the present invention the terms "fabric enhancement" and "fabric care" are used interchangeable throughout the present specification and stand equally well for one another. Fabric enhancement/fabric care is achieved when the properties inter alia color, fiber integrity of the garment are conserved (that is no further damage is done during the laundry process) or the damaging process is reversed and the fabric appears more like its original form.

Fabric Enhancing Polymers

The polyalkyleneimines of the present invention have the general formula:

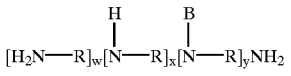

comprising primary, secondary and tertiary amine nitrogens connected by R units which are linking units. The primary units cap or terminate the main polyalkyleneimine chain as well as any branch chains whereas the secondary and tertiary units are randomly distributed throughout the polyalkyleneimine molecule chain.

The units which make up the polyalkyleneimine backbones are primary amine units having the formula:

$H_2N—R]—$ and $—NH_2$ which terminate the main backbone and any branching chains, secondary amine units having the formula:

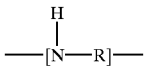

and tertiary amine units having the formula:

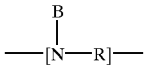

which are the branching points of the main and secondary backbone chains, B representing a continuation of the chain structure by branching. During the formation of the polyalkyleneimine cyclization may occur, therefore, an amount of cyclic polyalkyleneimine can be present in the polyalkyleneimine admixture.

R is $C_2$–$C_4$ linear alkylene, $C_3$–$C_4$ branched alkylene, and mixtures thereof, preferably R is ethylene. The prefered polyalkyleneimines of the present invention are polyethyleneimines (PEI's) wherein 100% of the R units are ethylene.

For the purposes of the present invention the term "molecular weight" is "an average molecular weight of the polyalkyleneimines present in the material which is incorporated into the present compositions". Those of ordinary skill in the art will recognize that a particular sample of polyalkyleneimine, especially as the average molecular weight increases, will comprise an admixture of polyamine having a range of molecular weights. Preferably the lowest average molecular weight of the polyalkyleneimines of the present invention is about 5200 dalton, wherein the lowest molecular weight of any polyalkyleneimine present in the 5200 dalton sample is 5000 dalton. Therefore there is a range for the preferred lowest average molecular weight of plus or minus 200 dalton. More preferably the average molecular weight of the polyalkyleneimines is from about 10,000 dalton, most preferably from about 20,000 dalton to about 320,000 dalton, preferably to about 200,000 dalton, more preferably to about 150,000 dalton. The polyalkyleneimines of the present invention which have an average molecular weight of about 320,000 dalton will preferably comprise polyalkyleneimines which do not exceed 500,000 dalton molecular weight.

The indices w, x, and y reflect the possible relative ratios of the primary, secondary, and tertiary backbone units possible in the polyalkyleneimines of the present invention and do not necessary reflect the minimum nor maximum molecular weight of a polyamine which is present in the admixture. The index w, for non-cyclic polyalkyleneimines, will always equal the value of x+1. The preferred maximal ratio of secondary units to tertiary units is 1 to 20 (x equal to 50 and y equal to 100) and would comprise a highly branched polyalkyleneimine. The preferred minimal ratio of secondary units to tertiary units is 125 to 1 (x equal to 2500 and y equal to 20) which for the purposes of the present invention is a "linear polyalkyleneimine".

For the purposes of the present invention "linear polyalkyleneimine" is defined as "polyamines wherein less than 1 tertiary unit is present for every 100 secondary unit which is present." For the purposes of the present invention "substantially linear polyalkyleneimine" is defined as "polyamines wherein the ratio of secondary units to tertiary units is from about 100 secondary units present for every 1 tertiary unit present to about 2 secondary units present for 1 tertiary unit present (from about 100:1 to about 2:1)." For the purposes of the present invention "substantially branched polyalkyleneimine" is defined as "polyamines wherein the ratio of secondary units to tertiary units is from about 2 secondary units present for every 1 tertiary unit present to about 1 secondary unit present for every 2 tertiary unit present (from about 2:1 to about 1:2)." For the purposes of the present invention "branched polyalkyleneimine" is defined as "polyamines wherein the ratio of secondary units to tertiary units is from about 1 secondary unit present for every 2 tertiary units present to about 1 secondary unit present for every 20 tertiary units present (from about 1:2 to about 1:20)."

However, for the purposes of the present invention, there is no absolute preferred ratios of secondary to tertiary units. For example the formulator may wish to include a "substantially linear polyalkyleneimine" having an average molecular weight of about 200,000 in one compositions and a "substantially branched polyalkyleneimine" having an average molecular weight of about 40,000 daltons in another embodiment.

The polyalkyleneimines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing the polyalkyleneimines of the present invention are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

An example of a preferred polyalkyleneimine according to the present invention is a polyethyleneimine having an average molecular weight of about 25,000 dalton (PEI 25,000) wherein the average ratio of secondary units to tertiary units is from about 4:1 to about 1.5:1.

Laundry Detergent Compositions

The laundry detergent compositions of the present invention take the basic form which comprises:

a) from about 0.01% by weight, of a polyalkyleneimine having the formula:

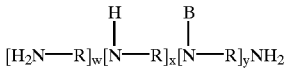

wherein R is $C_2$–$C_4$ linear alkylene, $C_3$–$C_4$ branched alkylene, and mixtures thereof, B is a continuation of said polyalkyleneimine by branching; w is equal to y+1; x is an integer of from about 50 to about 2500; y is an integer of from about 20 to about 1000;

b) from about 0.01% by weight, of a detersive surfactant selected from the group consisting of anionic, cationic, nonionic, zwitterionic, ampholytic surfactants, and mixtures thereof; and c) the balance carriers and adjunct ingredients, wherein said adjunct ingredients are selected from the group consisting of builders, optical brighteners, soil release polymers, dispersents, enzymes, suds suppressers, dyes, perfumes, colorants, filler salts, hydrotropes, photoactivators, fluorescers, fabric conditioners, hydrolyzable surfactants, preservatives, anti-oxidants, chelants, stabilizers, anti-shrinkage agents, anti-wrinkle agents, germicides, fungicides, anti-corrosion agents, and mixtures thereof.

Surfactant System

The laundry detergent compositions of the present invention may comprise at least about 0.01% by weight, preferably from about 0.1% to about 60%, preferably to about 30% by weight, of a detersive surfactant system, said system is comprised of one or more category of surfactants depending upon the embodiment, said categories of surfactants are selected from the group consisting of anionic, cationic, nonionic, zwitterionic, ampholytic surfactants, and mixtures thereof. Within each category of surfactant, more than one type of surfactant of surfactant can be selected. For example, preferably the solid (i.e. granular) and viscous semi-solid (i.e. gelatinous, pastes, etc.) systems of the present invention, surfactant is preferably present to the extent of from about 0.1% to 60%, preferably to about 30% by weight of the composition.

Nonlimiting examples of surfactants useful herein include:

a) $C_{11}$–$C_{18}$ alkyl benzene sulfonates (LAS);

b) $C_{10}$–$C_{20}$ primary, branched-chain and random alkyl sulfates (AS);

c) $C_{10}$–$C_{18}$ secondary (2,3) alkyl sulfates having the formula:

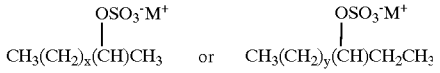

wherein x and (y+1) are integers of at least about 7, preferably at least about 9; said surfactants disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference;

d) $C_{10}$–$C_{18}$ alkyl alkoxy sulfates (AExS) wherein preferably x is from 1–7;

e) $C_{10}$–$C_{18}$ alkyl alkoxy carboxylates preferably comprising 1–5 ethoxy units;

f) $C_{12}$–$C_{18}$ alkyl ethoxylates, $C_6$–$C_{12}$ alkyl phenol alkoxylates wherein the alkoxylate units are a mixture of ethyleneoxy and propyleneoxy units, $C_{12}$–$C_{18}$ alcohol and $C_6$–$C_{12}$ alkyl phenol condensates with ethylene oxide/propylene oxide block polymers inter alia Pluronic® ex BASF which are disclosed in U.S. Pat. No. 3,929,678 Laughlin et al., issued Dec. 30, 1975, incorporated herein by reference;

g) Alkylpolysaccharides as disclosed in U.S. Pat. No. 4,565,647 Llenado, issued Jan. 26, 1986, incorporated herein by reference;

h) Polyhydroxy fatty acid amides having the formula:

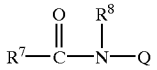

wherein $R^7$ is $C_5$–$C_{31}$ alkyl; $R^8$ is selected from the group consisting of hydrogen, $C_1$–$C_4$ alkyl, $C_1$–$C_4$ hydroxyalkyl, Q is a polyhydroxyalkyl moiety having a linear alkyl chain with at least 3 hydroxyls directly connected to the chain, or an alkoxylated derivative thereof; preferred alkoxy is ethoxy or propoxy, and mixtures thereof; preferred Q is derived from a reducing sugar in a reductive amination reaction, more preferably Q is a glycityl moiety; Q is more preferably selected from the group consisting of $—CH_2(CHOH)_n CH_2OH$, $—CH(CH_2OH)(CHOH)_{n-1}CH_2OH$, $—CH_2(CHOH)_2—(CHOR')(CHOH)CH_2OH$, and alkoxylated derivatives thereof, wherein n is an integer from 3 to 5, inclusive, and R' is hydrogen or a cyclic or aliphatic monosaccharide, which are described in U.S. Pat. No. 5,489,393 Connor et al., issued Feb. 6, 1996; and U.S. Pat. No. 5,45,982 Murch et al., issued Oct. 3, 1995, both incorporated herein by reference.

The laundry detergent compositions of the present invention can also comprise from about 0.001% to about 100% of one or more (preferably a mixture of two or more) mid-chain branched surfactants, preferably mid-chain branched alkyl alkoxy alcohols having the formula:

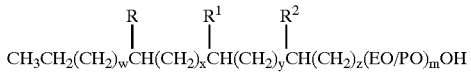

mid-chain branched alkyl sulfates having the formula:

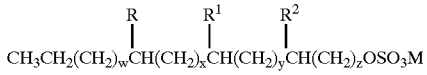

and mid-chain branched alkyl alkoxy sulfates having the formula:

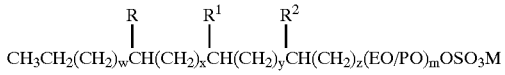

wherein the total number of carbon atoms in the branched primary alkyl moiety of these formulae (including the R, $R^1$, and $R^2$ branching, but not including the carbon atoms which comprise any EO/PO alkoxy moiety) is from 14 to 20, and wherein further for this surfactant mixture the average total number of carbon atoms in the branched primary alkyl moieties having the above formula is within the range of greater than 14.5 to about 17.5 (preferably from about 15 to about 17); R, $R^1$, and $R^2$ are each independently selected from hydrogen, $C_1$–$C_3$ alkyl, and mixtures thereof, preferably methyl; provided R, $R^1$, and $R^2$ are not all hydrogen and, when z is 1, at least R or $R^1$ is not hydrogen. M is a water soluble cation and may comprises more than one type of cation, for example, a mixture of sodium and potassium. The index w is an integer from 0 to 13; x is an integer from 0 to 13; y is an integer from 0 to 13; z is an integer of at least 1; provided w+x+y+z is from 8 to 14. EO and PO represent ethyleneoxy units and propyleneoxy units having the formula:

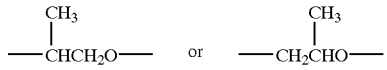

respectively, however, other alkoxy units inter alia 1,3-propyleneoxy, butoxy, and mixtures thereof are suitable as alkoxy units appended to the mid-chain branched alkyl moieties.

The mid-chain branched surfactants are preferably mixtures which comprise a surfactant system. Therefore, when the surfactant system comprises an alkoxylated surfactant, the index m indicates the average degree of alkoxylation within the mixture of surfactants. As such, the index m is at least about 0.01, preferably within the range of from about 0.1, more preferably from about 0.5, most preferably from about 1 to about 30, preferably to about 10, more preferably to about 5. When considering a mid-chain branched surfactant system which comprises only alkoxylated surfactants, the value of the index m represents a distribution of the average degree of alkoxylation corresponding to m, or it may be a single specific chain with alkoxylation (e.g., ethoxylation and/or propoxylation) of exactly the number of units corresponding to m.

The preferred mid-chain branched surfactants of the present invention which are suitable for use in the surfactant systems of the present invention have the formula:

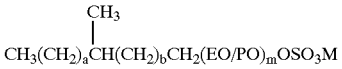

or the formula:

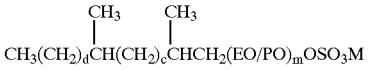

wherein a, b, d, and e are integers such that a+b is from 10 to 16 and d+e is from 8 to 14; M is selected from sodium, potassium, magnesium, ammonium and substituted ammonium, and mixtures thereof.

The surfactant systems of the present invention which comprise mid-chain branched surfactants are preferably formulated in two embodiments. A first preferred embodiment comprises mid-chain branched surfactants which are formed from a feedstock which comprises 25% or less of mid-chain branched alkyl units. Therefore, prior to admixture with any other conventional surfactants, the mid-chain branched surfactant component will comprise 25% or less of surfactant molecules which are non-linear surfactants.

A second preferred embodiment comprises mid-chain branched surfactants which are formed from a feedstock which comprises from about 25% to about 70% of mid-chain branched alkyl units. Therefore, prior to admixture with any other conventional surfactants, the mid-chain branched surfactant component will comprise from about 25% to about 70% surfactant molecules which are non-linear surfactants.

The surfactant systems of the laundry detergent compositions of the present invention can also comprise from about 0.001%, preferably from about 1%, more preferably from about 5%, most preferably from about 10% to about 100%, preferably to about 60%, more preferably to about 30% by weight, of the surfactant system, of one or more (preferably a mixture of two or more) mid-chain branched alkyl arylsulfonate surfactants, preferably surfactants wherein the aryl unit is a benzene ring having the formula:

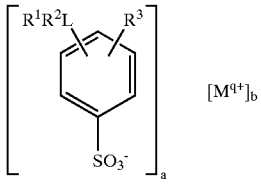

wherein L is an acyclic hydrocarbyl moiety comprising from 6 to 18 carbon atoms; $R^1$, $R^2$, and $R^3$are each independently hydrogen or $C_1$–$C_3$ alkyl, provided $R^1$ and $R^2$ are not attached at the terminus of the L unit; M is a water soluble cation having charge q wherein a and b are taken together to satisfy charge neutrality.

The present invention also comprises a chelant having a formula:

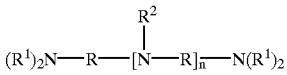

wherein R is ethylene, 1,2-propylene, 1,3-propylene, and mixtures thereof; $R^1$ is hydrogen, $C_1$–$C_4$ alkyl, 2-hydroxypropyl, alkyleneoxy having the formula:

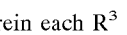

wherein each $R^3$ is independently ethylene, 1,2-propylene, 1,2-butylene, or mixtures thereof, $R^4$ is hydrogen, $C_1$–$C_4$ alkyl, or mixtures thereof, and mixtures thereof; $R^2$ is $R^1$, —$RN(R^1)_2$, and mixtures thereof; n is from 0 to 3.

Adjunct Ingredients

The following are non-limiting examples of adjunct ingredients useful in the laundry compositions of the present invention, said adjunct ingredients include builders, optical brighteners, soil release polymers, dispersents, enzymes, suds suppressers, dyes, perfumes, colorants, filler salts, hydrotropes, photoactivators, fluorescers, fabric conditioners, hydrolyzable surfactants, preservatives, antioxidants, chelants, stabilizers, anti-shrinkage agents, anti-wrinkle agents, germicides, fungicides, anti corrosion agents, and mixtures thereof.

Builders—The laundry detergent compositions of the present invention preferably comprise one or more detergent builders or builder systems. When present, the compositions will typically comprise at least about 1% builder, preferably from about 5%, more preferably from about 10% to about 80%, preferably to about 50%, more preferably to about 30% by weight, of detergent builder.

The level of builder can vary widely depending upon the end use of the composition and its desired physical form. When present, the compositions will typically comprise at least about 1% builder. Formulations typically comprise from about 5% to about 50%, more typically about 5% to about 30%, by weight, of detergent builder. Granular formulations typically comprise from about 10% to about 80%, more typically from about 15% to about 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839 Rieck, issued May 12, 1987. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$[M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}]xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Dispersants

A description of other suitable polyalkyleneimine dispersants which may be optionally combined with the bleach stable dispersants of the present invention can be found in U.S. Pat. No. 4,597,898 Vander Meer, issued Jul. 1, 1986; European Patent Application 111,965 Oh and Gosselink, published Jun. 27, 1984; European Patent Application 111,984 Gosselink, published Jun. 27, 1984; European Patent Application 112,592 Gosselink, published Jul. 4, 1984; U.S. Pat. No. 4,548,744 Connor, issued Oct. 22, 1985; and U.S. Pat. No. 5,565,145 Watson et al., issued Oct. 15, 1996; all of which are included herein by reference. However, any suitable clay/soil dispersant or anti-redepostion agent can be used in the laundry compositions of the present invention.

In addition, polymeric dispersing agents which include polymeric polycarboxylates and polyethylene glycols, are suitable for use in the present invention. Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, acomitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000, preferably from about 5,000, more preferably from about 7,000 to 100,000, more preferably to 75,000, most preferably to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Soil Release Agents

The compositions according to the present invention may optionally comprise one or more soil release agents. If utilized, soil release agents will generally comprise from about 0.01%, preferably from about 0.1%, more preferably from about 0.2% to about 10%, preferably to about 5%, more preferably to about 3% by weight, of the composition. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and, thus, serve as an anchor for the hydrophilic segments. This can enable stains occuring subsequent to treatment with the soil release agent to be more easily cleaned in later washing procedures.

The following, all included herein by reference, describe soil release polymers suitable for use in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,771,730 Gosselink et al., issued Oct. 27, 1987; U.S. Pat. No. 711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. Nos. 4,220,918; 4,787,989; EP 279,134 A, 1988 to Rhone-Poulenc Chemie; EP 457,205 A to BASF (1991); and DE 2,335,044 to Unilever N. V., 1974; all incorporated herein by reference.

As a non-limiting example, granular compositions are generally made by combining base granule ingredients, e.g., surfactants, builders, water, etc., as a slurry, and spray drying the resulting slurry to a low level of residual moisture (5–12%). The remaining dry ingredients, e.g., granules of the polyalkyleneimine dispersant, can be admixed in granular powder form with the spray dried granules in a rotary mixing drum. The liquid ingredients, e.g., solutions of the polyalkyleneimine dispersant, enzymes, binders and perfumes, can be sprayed onto the resulting granules to form the finished detergent composition. Granular compositions according to the present invention can also be in "compact form", i.e. they may have a relatively higher density than conventional granular detergents, i.e. from 550 to 950 g/l. In such case, the granular detergent compositions according to the present invention will contain a lower amount of "inorganic filler salt", compared to conventional granular detergents; typical filler salts are alkaline earth metal salts of sulphates and chlorides, typically sodium sulphate; "compact" detergents typically comprise not more than 10% filler salt.

Liquid detergent compositions can be prepared by admixing the essential and optional ingredients thereof in any desired order to provide compositions containing components in the requisite concentrations. Liquid compositions according to the present invention can also be in "compact form", in such case, the liquid detergent compositions according to the present invention will contain a lower amount of water, compared to conventional liquid detergents. Addition of the polyalkyleneimine dispersant to liquid detergent or other aqueous compositions of this invention may be accomplished by simply mixing into the liquid solutions the polyalkyleneimine dispersant.

The compositions of the present invention can be suitably prepared by any process chosen by the formulator, non-limiting examples of which are described in U.S. Pat. No. 5,691,297 Nassano et al., issued Nov. 11, 1997; U.S. Pat. No. 5,574,005 Welch et al., issued Nov. 12, 1996; U.S. Pat. No. 5,569,645 Dinniwell et al., issued Oct. 29, 1996; U.S. Pat. No. 5,565,422 Del Greco et al., issued Oct. 15, 1996; U.S. Pat. No. 5,516,448 Capeci et al., issued May 14, 1996; U.S. Pat. No. 5,489,392 Capeci et al., issued Feb. 6, 1996; U.S. Pat. No. 5,486,303 Capeci et al., issued Jan. 23, 1996 all of which are incorporated herein by reference.

Method of Use

The present invention also relates to a method for using the laundry detergent or pre-soak compositions to suitably clean fabric.

The methods of the present invention include a method for cleaning fabric comprising the step of contacting fabric in need of cleaning with an aqueous solution containing a least 50 ppm, preferably at least about 100 ppm, more preferably at least about 200 ppm, of a laundry detergent composition which comprises:

a) from about 0.01% by weight, of a detersive surfactant selected from the group consisting of anionic, cationic, nonionic, zwitterionic, ampholytic surfactants, and mixtures thereof;

b) from about 0.01% by weight, of a high molecular weight polyamine as described herein above; and c) the balance carriers and adjunct ingredients.

The detergent compositions according to the present invention can be in liquid, paste, laundry bar, or granular form. Such compositions can be prepared by combining the essential and optional components in the requisite concentrations in any suitable order and by any conventional means.

The following is a non-limiting example of a laundry detergent composition according to the present invention.

TABLE I

| Ingredients | weight % | | | |
|---|---|---|---|---|
| | 1 | 2 | 3 | 4 |
| Polyhydroxy coco-fatty acid amide | 2.50 | 4.00 | 4.50 | — |
| NEODOL 24-7[1] | — | 4.50 | — | — |
| NEODOL 23-9[2] | 0.63 | — | 4.50 | 2.00 |
| $C_{25}$ Alkyl ethoxylate sulphate | 20.15 | 4.00 | 5.50 | 20.50 |
| $C_{25}$ Alkyl sulfate | — | 14.00 | 15.00 | — |
| C11.8 linear alkylbenzene sulfonate | — | — | — | 6.00 |
| $C_{8-10}$-Amidopropyl Amine | — | 1.30 | — | — |
| $C_{10}$-Amidopropyl Amine | 0.50 | — | — | 1.50 |
| Citric acid | 3.00 | 2.00 | 3.00 | 2.50 |
| C12–18 fatty acid | 2.00 | 6.50 | 5.00 | 5.00 |
| Rapeseed fatty acid | — | 4.10 | — | 6.50 |
| Ethanol | 3.36 | 1.53 | 5.60 | 0.50 |
| Propanediol | 7.40 | 9.20 | 6.22 | 4.00 |
| Monoethanolamine | 1.00 | 7.90 | 8.68 | 0.50 |
| Sodium hydroxide | 2.75 | 1.30 | 0.75 | 4.40 |
| Sodium p-toluene sulfonate | 2.25 | — | 1.90 | — |
| Borax/Boric acid | 2.50 | 2.00 | 3.50 | 2.50 |
| Protease[3] | 0.88 | 0.74 | 1.50 | 0.88 |
| Lipolase[4] | — | 0.12 | 0.18 | — |
| Duramyl[5] | 0.15 | 0.11 | — | 0.15 |
| CAREZYME | 0.053 | 0.028 | 0.080 | 0.053 |
| Dispersant[6] | 0.60 | 0.70 | 1.50 | 0.60 |
| Ethoxylated polyalkyleneimine[7] | 1.20 | 0.70 | 1.50 | 1.20 |
| Optical Brightener | 0.13 | 0.15 | 0.30 | 0.15 |
| Polyamine[8] | 0.25 | 1.00 | — | — |
| Polyamine[9] | — | — | 0.50 | — |
| Polyamine[10] | — | — | — | 1.00 |
| Suds suppresser | 0.12 | 0.28 | 0.12 | 0.12 |
| Minors, aesthetics, stabilizers, water | balance | balance | balance | balance |

[1] $C_{12}$—$C_{14}$ alkyl ethoxylate as sold by Shell Oil Co.
[2] $C_{12}$—$C_{13}$ alkyl ethoxylate as sold by Shell Oil Co.
[3] Protease B variant of BPN' wherein Tyr 17 is replaced with Leu.
[4] Derived from *Humicola lanuginosa* and commercially available from Novo.
[5] Disclosed in WO 9510603 A and available from Novo.
[6] Hydrophilic dispersant PEI 189 $E_{15}$—$E_{18}$ according to U.S. Pat. No. 4,597,898, Vander Meer, issued July 1, 1986.
[7] Polyalkyleneimine dispersant PEI 600 $E_{20}$.
[8] Polyalkyleneimine having an average molecular weight of about 25,000 daltons.
[9] Polyalkyleneimine having an average molecular weight of about 20,000 daltons.
[10] Polyalkyleneimine having an average molecular weight of about 6,000 daltons.

What is claimed is:

1. A laundry detergent composition comprising no dye transfer agents and:

a) from about 0.01% to about 20% by weight, of a polyalkyleneimine having the formula:

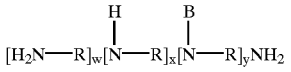

wherein R is $C_2$–$C_4$ linear alkylene, $C_3$–$C_4$ branched alkylene, and mixtures thereof; B is a continuation of said polyalkyleneimine by branching; w is equal to y+1; x is an integer of from about 50 to about 2500; y is an integer of from about 20 to about 1000;

b) from about 0.01% to about 60% by weight, of a detersive surfactant selected from the group consisting of anionic, cationic, nonionic, zwitterionic, ampholytic surfactants, and mixtures thereof;

c) a chelant having the formula:

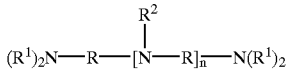

wherein R is ethylene, 1,2-propylene, 1,3-propylene, and mixtures thereof; $R^1$ is hydrogen, $C_1$–$C_4$ alkyl, 2-hydroxypropyl, alkyleneoxy having the formula:

$$—(R^3O)—R^4$$

wherein each $R^3$ is independently ethylene, 1,2-propylene, 1,2-butylene, or mixtures thereof, $R^4$ is hydrogen, $C_1$–$C_4$ alkyl, or mixtures thereof, and mixtures thereof; $R^2$ is $R^1$, $—RN(R^1)_2$, and mixtues thereof; n is from 0 to 3; and d) the balance carriers and adjunct ingredients.

2. A composition according to claim 1 further comprising adjunct ingredients selected from the group consisting of electrolytes, stabilizers, low molecular weight water soluble solvents, chelating agents, cationic charge boosters, dispersibility aids, soil release agents, nonionic fabric softening agents, concentration aid, perfume, preservatives, colorants, optical brighteners, opacifiers, fabric care agents, anti-shrinkage agents, anti-wrinkle agents, fabric crisping agents, spotting agents, germicides, fungicides, anti-corrosion agents, antifoam agents, and mixtures thereof.

3. A composition according to claim 1 wherein the index x is an integer from about 100 to about 1000.

4. A composition according to claim 1 wherein the index y is an integer from about 50 to about 500.

5. A composition according to claim 1 wherein x is an integer of from about 100 to 250; y is an integer of from 50 to 500.

6. A composition according to claim 1 further comprising at least 1% by weight, of a builder.

7. A method for cleaning fabric comprising the step of contacting fabric in need of cleaning with an aqueous solution containing a least 50 ppm of a laundry detergent composition which comprises dye transfer agents and:

a) from about 0.01% to about 20% by weight, of a polyalkyleneimine having the formula:

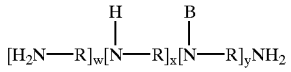

wherein R is $C_2$–$C_4$ linear alkylene, $C_3$–$C_4$ branched alkylene, and mixtures thereof; B is a continuation of said polyalkyleneimine by branching; w is equal to y+1; x is an integer of from about 50 to about 2500; y is an integer of from about 20 to about 1000;

b) from about 0.01% to about 60% by weight, of a detersive surfactant selected from the group consisting of anionic, cationic, nonionic, zwitterionic, ampholytic surfactants, and mixtures thereof;

c) a chelant having the formula:

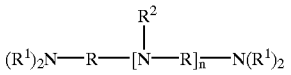

wherein R is ethylene, 1,2-propylene, 1,3-propylene, and mixtures thereof; $R^1$ is hydrogen, $C_1$–$C_4$ alkyl, 2-hydroxypropyl, alkyleneoxy having the formula:

$$—(R^3O)—R^4$$

wherein each $R^3$ is independently ethylene, 1,2-propylene, 1,2-butylene, or mixtures thereof, $R^4$ is hydrogen, $C_1$–$C_4$ alkyl, or mixtures thereof, and mixtures thereof; $R^2$ is $R^1$, $—RN(R^1)_2$, and mixtures thereof; n is from 0 to 3; and d) the balance carriers and adjunct ingredients.

8. A method according to claim 7 further comprising adjunct ingredients selected from the group consisting of electrolytes, stabilizers, low molecular weight water soluble solvents, chelating agents, cationic charge boosters, dispersibility aids, soil release agents, nonionic fabric softening agents, concentration aid, perfume, preservatives, colorants, optical brighteners, opacifiers, fabric care agents, anti-shrinkage agents, anti-wrinkle agents, fabric crisping agents, spotting agents, germicides, fungicides, anti-corrosion agents, antifoam agents, and mixtures thereof.

9. A method according to claim 7 wherein the index x is an integer from about 100 to about 1000.

10. A method according to claim 7 wherein the index y is an integer from about 50 to about 500.

11. A method according to claim 7 wherein x is an integer of from about 100 to 250; y is an integer of from 50 to 500.

* * * * *